US011335495B1

(12) United States Patent
Mogaveera et al.

(10) Patent No.: US 11,335,495 B1
(45) Date of Patent: May 17, 2022

(54) SYSTEM TO OPTIMIZE VOLTAGE DISTRIBUTION ALONG HIGH VOLTAGE RESISTOR STRING IN ICT HIGH VOLTAGE POWER SUPPLY

(71) Applicant: Applied Materials, Inc., Santa Clara, CA (US)

(72) Inventors: Vasu Mogaveera, Bangalore (IN); Piotr R. Lubicki, Peabody, MA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/166,413

(22) Filed: Feb. 3, 2021

(51) Int. Cl.
*H01F 27/28* (2006.01)
*H01F 27/40* (2006.01)

(52) U.S. Cl.
CPC ..... *H01F 27/2804* (2013.01); *H01F 27/40* (2013.01); *H01F 2027/2809* (2013.01)

(58) Field of Classification Search
CPC ..... H01F 27/2804; H01F 27/40; H01F 2027/2809; H01F 27/28
See application file for complete search history.

(56) References Cited

U.S. PATENT DOCUMENTS

| | | | |
|---|---|---|---|
| 3,239,751 | A | 3/1966 | Sibary |
| 3,317,659 | A | 5/1967 | Frey |
| 4,034,283 | A | 7/1977 | Pellegrino |
| 5,008,913 | A | 4/1991 | Negle |
| 2006/0109033 | A1 | 5/2006 | Sundaram |

FOREIGN PATENT DOCUMENTS

WO WO-9219085 A1 * 10/1992 ..... H02M 7/10

* cited by examiner

*Primary Examiner* — Robert L Deberadinis
(74) *Attorney, Agent, or Firm* — Nields, Lemack & Frame, LLC

(57) ABSTRACT

An Insulated Core Transformer (ICT) high voltage DC power supply is disclosed. The power supply comprises a plurality of printed circuit boards, each comprising a secondary winding and a voltage doubler circuit. These voltage doubler circuits are arranged in series. The stacked printed circuit boards are surrounded by a plurality of grading rings. The last grading ring is electrically connected to the output voltage. High voltage resistors are then disposed between adjacent grading rings to form a voltage divider. The voltage of the first grading ring may be used as part of a feedback system to regulate the output of the AC power supply. By disposing the high voltage resistors on the grading rings, a more uniform voltage gradient may be created.

19 Claims, 7 Drawing Sheets

SYSTEM TO OPTIMIZE VOLTAGE DISTRIBUTION ALONG HIGH VOLTAGE RESISTOR STRING IN ICT HIGH VOLTAGE POWER SUPPLY

FIELD

Embodiments of this disclosure are directed to systems for uniformly distributing voltage along a high voltage resistor string in an insulated core transformer high voltage power supply.

BACKGROUND

Insulated Core Transformer (ICT) high voltage power supplies are a method of generating a high voltage DC output from an AC voltage. The input AC voltage is in communication with a primary winding.

In certain embodiments, there is a single secondary winding that multiplies the input voltage by a factor equal to the ratio of the number of turns in the secondary winding to the number of turns in the primary winding. Rectification and doubling of the voltage is provided using a voltage doubler circuit, which comprises diodes and capacitors. Typically, the voltage doubler comprises two capacitors to store voltage and two diodes, each of which allows current flow in only one direction. The capacitors are arranged in series, resulting in a doubling of the voltage.

In other embodiments, there are a plurality of secondary windings, each with a dedicated voltage doubler circuit. The voltage doubler circuits are arranged in series to generate the desired higher DC voltage.

The ICT high voltage power supply comprises a plurality of stacked printed circuit boards, where each printed circuit board comprises one stage of the high voltage power supply. For example, if the desired high voltage output is intended to be 125 kV, there may be ten stacked printed circuit boards, each producing 12.5 kV. These printed circuit boards are connected in series, to generate the high voltage output.

Further, in some embodiments, the AC voltage is controlled via closed loop control. The actual output voltage is compared to the desired output voltage and the AC voltage is adjusted accordingly. This may be achieved by utilizing a voltage divider to create a low DC voltage that is a predetermined percentage of the output voltage. For example, a voltage divider may be used to create a 10V output from the 125 kV output voltage. This 10V output is then used as part of the feedback to control the AC voltage.

Because of the magnitude of the high voltage output, the voltage divider is typically created using a plurality of high voltage resistors and one or more low voltage resistors. For example, to create a 10V output, five 400 MΩ resistors may be arranged in series to form the high voltage resistor string. One end of the high voltage resistor string may be connected to the output voltage, and the second end of the high voltage resistor string may be connected to a low voltage resistor, such as a 160 kΩ resistor. The other end of the low voltage resistor may be grounded. If the output voltage is indeed 125 kV, the voltage across the low voltage resistor may be 10V. If the output voltage differs from the desired output, the voltage across the low voltage resistor will differ from this voltage.

However, in certain embodiments, due to stray capacitance, the voltage across the plurality of high voltage resistors may not be equal, such that some resistors dissipate less than the ideal voltage, while other resistors are forced to dissipate more than the ideal voltage.

This non-uniform distribution of voltage across the resistors may lead to voltage stress on these components, which may result in premature component failure. In addition to voltage stress, a voltage measurement error also occurs as the current entering and leaving each resistor in the voltage divider may not be the same due to stray capacitance. This causes differences between the actual output voltage and the measured output voltage.

Therefore, it would be advantageous if there were a system and method to improve the voltage uniformity across these components. Further, it would be beneficial if this approach was low cost and easy to implement.

SUMMARY

An Insulated Core Transformer (ICT) high voltage DC power supply is disclosed. The power supply comprises a plurality of printed circuit boards, each comprising a secondary winding and a voltage doubler circuit. These voltage doubler circuits are arranged in series. The stacked printed circuit boards are surrounded by a plurality of grading rings. The last grading ring is electrically connected to the high voltage output. High voltage resistors are then disposed between adjacent grading rings to form a voltage divider. The voltage of the first grading ring may be used as part of a feedback system to regulate the output of the AC power supply. By disposing the high voltage resistors on the grading rings, a more uniform voltage gradient may be created.

According to one embodiment, a high voltage DC power supply for generating a DC voltage is disclosed. The high voltage DC power supply comprises a primary winding; a plurality of stacked printed circuit boards, including a first printed circuit board and a last printed circuit board, each printed circuit board comprising: a secondary winding, having a first end and a second end; and a voltage multiplier circuit, in communication with the secondary winding and having a high voltage output and a lower voltage; wherein the high voltage output of a first printed circuit board is in communication with the lower voltage of an adjacent second printed circuit board and the high voltage output of the last printed circuit board comprises the DC voltage; and a plurality of grading rings surrounding the plurality of stacked printed circuit boards, wherein a last of the plurality of grading rings is in communication with the DC voltage; and high voltage resistors disposed between adjacent grading rings to form a voltage divider, wherein a first of the plurality of the grading rings is connected to one terminal of a low voltage resistor and a second terminal of the low voltage resistor is connected to ground, wherein a voltage across the low voltage resistor is indicative of the DC voltage. In certain embodiments, there is at least one additional printed circuit board disposed between the first printed circuit board and the last printed circuit board. In some embodiments, there is at least one additional grading ring disposed between the first of the plurality of the grading rings and the last of the plurality of grading rings. In some embodiments, a voltage generated by each voltage multiplier circuit is the same. In some embodiments, the high voltage DC power supply comprises an AC power supply in communication with the primary winding, and a feedback system in communication with the AC power supply. In certain embodiments, the voltage across the low voltage resistor is used by the feedback system to control an output of the AC power supply. In certain embodiments, a measurement error associated with the voltage across the low voltage resistor is reduced by a factor of at least 3, as compared to an embodiment wherein the grading rings are not employed. In some embodiments, at least one of the plurality of stacked printed circuit boards comprises more than one voltage multiplier circuit. In certain embodiments, the voltage multiplier circuit comprises a voltage doubler circuit. In certain further embodiments, the voltage doubler circuit comprises a capacitor string, comprising a plurality of capacitors arranged in series, wherein a negative end of a first capacitor in the capacitor string is at the lower voltage and a positive end of a last capacitor in the capacitor string is at the high voltage output; and a diode string, comprising a plurality of diode arranged in series, wherein an anode of a first diode in the diode string is connected to the lower voltage and a cathode of a last diode in the diode string is connected to the high voltage output; wherein the first end of the secondary winding is electrically connected to a midpoint of the capacitor string and the second end of the secondary winding is electrically connected to a midpoint of the diode string. In some embodiments, each printed circuit board comprises at least one additional secondary winding, having a first end and a second end; and wherein the voltage multiplier circuit comprises a plurality of low voltage doubler circuits, arranged in series, to form the voltage multiplier circuit having the lower voltage at a first end and the high voltage output at a second end, wherein each low voltage doubler circuit comprises a positive end and a negative end and comprises a first capacitor and a second capacitor arranged in series and a first diode and a second diode arranged in series, wherein a positive end of the first capacitor is electrically connected to a cathode of the first diode and comprises the positive end of the low voltage doubler circuit, and a negative end of a second capacitor is electrically connected to an anode of the second diode and comprises the negative end of the low voltage doubler circuit, wherein a first end of a respective secondary winding is electrically connected to a trace connecting the first capacitor and the second capacitor, and the second end of the respective secondary winding is electrically connected to a trace connecting the first diode and the second diode.

According to another embodiment, a high voltage DC power supply for generating a DC voltage is disclosed. The high voltage DC power supply comprises a primary winding; a plurality of stacked printed circuit boards, including a first printed circuit board and a last printed circuit board, each printed circuit board comprising: a secondary winding, having a first end and a second end; and a voltage multiplier circuit, in communication with the secondary winding and having a high voltage output and a lower voltage; wherein the high voltage output of a first printed circuit board is in communication with the lower voltage of an adjacent second printed circuit board and the high voltage output of the last printed circuit board comprises the DC voltage; and a plurality of grading rings surrounding the plurality of stacked printed circuit boards, wherein a last of the plurality of grading rings is in communication with the DC voltage; and high voltage resistors are disposed between adjacent grading rings to form a voltage divider, wherein a first of the grading rings is connected to ground. In certain embodiments, there is at least one additional printed circuit board disposed between the first printed circuit board and the last printed circuit board. In some embodiments, there is at least one additional grading ring disposed between the first of the plurality of the grading rings and the last of the plurality of grading rings. In some embodiments, a voltage generated by each voltage multiplier circuit is the same. In some embodiments, at least one of the plurality of stacked printed circuit boards comprises more than one voltage multiplier circuit. In certain embodiments, the voltage multiplier circuit comprises a voltage doubler circuit. In certain further embodiments, the voltage doubler circuit comprises a capacitor string, comprising a plurality of capacitors arranged in series, wherein a negative end of a first capacitor in the capacitor string is at the lower voltage and a positive end of a last capacitor in the capacitor string is at the high voltage output; and a diode string, comprising a plurality of diode arranged in series, wherein an anode of a first diode in the diode string is connected to the lower voltage and a cathode of a last diode in the diode string is connected to the high voltage output; wherein the first end of the secondary winding is electrically connected to a midpoint of the capacitor string and the second end of the secondary winding is electrically connected to a midpoint of the diode string. In some embodiments, each printed circuit board comprises at least one additional secondary winding, having a first end and a second end; and wherein the voltage multiplier circuit comprises a plurality of low voltage doubler circuits, arranged in series, to form the voltage multiplier circuit having the lower voltage at a first end and the high voltage output at a second end, wherein each low voltage doubler circuit comprises a positive end and a negative end and comprises a first capacitor and a second capacitor arranged in series and a first diode and a second diode arranged in series, wherein a positive end of the first capacitor is electrically connected to a cathode of the first diode and comprises the positive end of the low voltage doubler circuit, and a negative end of a second capacitor is electrically connected to an anode of the second diode and comprises the negative end of the low voltage doubler circuit, wherein a first end of a respective secondary winding is electrically connected to a trace connecting the first capacitor and the second capacitor, and the second end of the respective secondary winding is electrically connected to a trace connecting the first diode and the second diode.

BRIEF DESCRIPTION OF THE FIGURES

For a better understanding of the present disclosure, reference is made to the accompanying drawings, which are incorporated herein by reference and in which.

DETAILED DESCRIPTION

The present disclosure describes a system and method for creating a more uniform voltage distribution across a voltage divider and reduce voltage measurement error in an ICT high voltage DC power supply. Additionally, the present disclosure describes a system for creating a more uniform voltage distribution across a plurality of grading rings surrounding the ICT high voltage DC power supply.

Figure 1:
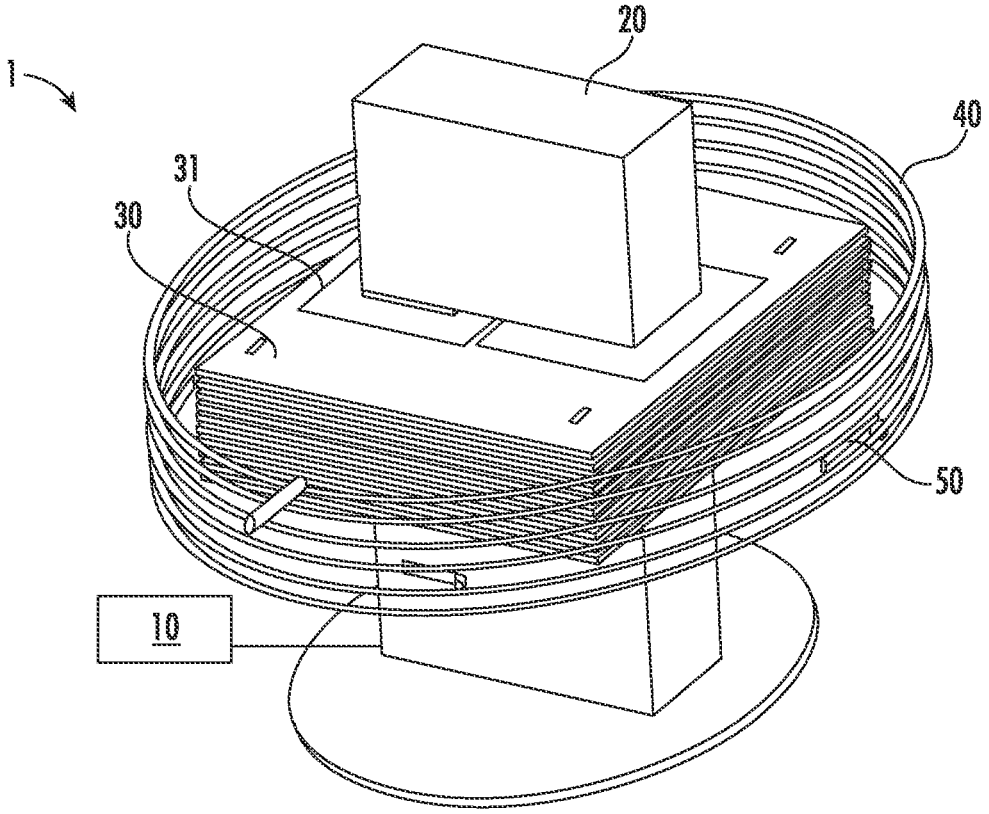
FIG. 1 shows a representative schematic showing a high voltage power supply in which voltage non-uniformity has been compensated according to one embodiment.

FIG. 1 shows a first embodiment of an ICT high voltage DC power supply 1. The ICT high voltage DC power supply 1 comprises a primary winding 20. The primary winding 20 may be connected to an AC voltage power supply 10. The primary winding 20 passes through one or more openings in each of a plurality of stacked printed circuit boards 30. For example, as shown in FIG. 1, the primary winding 20 rests on a ferrite bottom bar. Each of the printed circuit boards (PCBs) comprises one or more secondary windings 31 in proximity with ferrite bottom bar linking the magnetic flux. The secondary windings 31 on each PCB are in communication with a voltage multiplier circuit disposed on that printed circuit board 30, as described in more detail below. Further, in certain embodiments, each printed circuit board 30 may have two voltage multiplier circuits, each in communication with one or more secondary windings 31. Additionally, the output of the voltage multiplier circuit on one PCB may serve as the input voltage to the voltage multiplier circuit disposed on the adjacent PCB. In other words, the output of the voltage multiplier circuit on one printed circuit board 30 is cascaded in series with the voltage multiplier circuits on other printed circuit boards, formed in a stack to form the high voltage output. Each printed circuit board produces an independent voltage and is cascaded in series to generate the high voltage output. In certain embodiments, the voltage multiplier circuit comprises a voltage doubler circuit.

Figure 2:
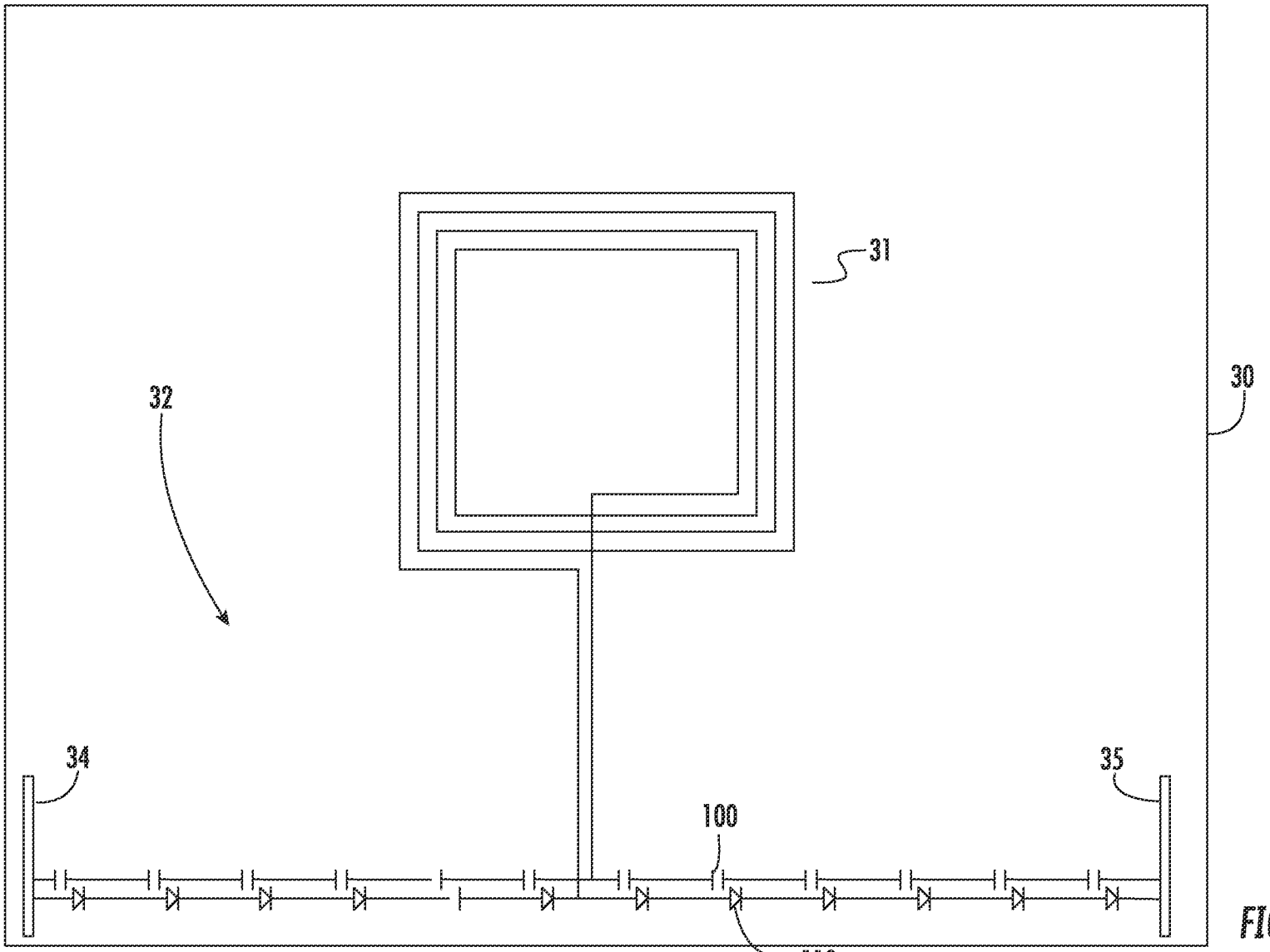
FIG. 2 shows a layout of a voltage doubler disposed on each of the printed circuit boards in the high voltage power supply of FIG. 1 according to one embodiment.

FIG. 2 shows a first embodiment of the voltage doubler circuit that may be disposed on each printed circuit board 30. The printed circuit board 30 may be a traditional printed circuit board having a plurality of layers, wherein conductive layers are separated from one another by an insulating material, such as FR4. In certain embodiments, the printed circuit board 30 may comprise two conductive layers; the top surface and the bottom surface. Electrical traces may be disposed on these layers of the printed circuit board. Via may be used to connect traces on the top surface to traces on the bottom surface. These electrical traces are used to electrically connect various components disposed on the printed circuit board. In other embodiments, there may be more than two conductive layers.

The voltage doubler circuit 32 also comprises a capacitor string. The string comprises a plurality of capacitors 100 arranged in series. The capacitors may each have the same capacitance and voltage rating. A first end of the capacitor string is connected to the lower voltage 34, and the second end of the capacitor string is connected to the higher voltage 35. The voltage doubler circuit 32 also comprises a string of diodes. The diode string comprises a plurality of diodes 110, also arranged in series. A first end of the diode string is connected to the lower voltage 34, and the second end of the diode string is connected to the higher voltage 35. The cathode of one diode is connected to an anode of an adjacent diode in the diode string. Thus, the anode of the first diode is connected to the lower voltage 34 and the cathode of the last diode in the diode string is connected to the higher voltage 35. During the positive portion of the AC cycle, the diodes disposed between the midpoint and the higher voltage 35 conduct current and charge the capacitors disposed between the midpoint and the higher voltage 35. During the negative portion of the AC cycle, diodes disposed between the midpoint and the lower voltage 34 conduct current and charge the capacitors disposed between the midpoint and the lower voltage 34. Thus, the cathode of each diode is at a higher voltage than the anode of that diode.

In certain embodiments, the number of diodes 110 and capacitors 100 is equal. In other embodiments, the number of diodes 110 and capacitors 100 may be different. The number of capacitors 100 and diodes 110 may be an even number such that there is an equal number of diodes and capacitors on each side of the midpoint. The first end of the secondary winding 31 is electrically connected to the midpoint of the capacitor string. The second end of the secondary winding 31 is electrically connected to the midpoint of the diode string. The midpoint denotes that the same number of capacitors 100 (and diodes 110) are disposed between the first end and the midpoint as are disposed between the midpoint and the second end.

While FIG. 2 shows twelve capacitors 100 and twelve diodes 110 the disclosure is not limited to this embodiment. Rather, the number of capacitors 100 and diodes 110 is not limited by this disclosure. Further, the number of capacitors 100 and diodes 110 do not need to be the same.

Figure 3:
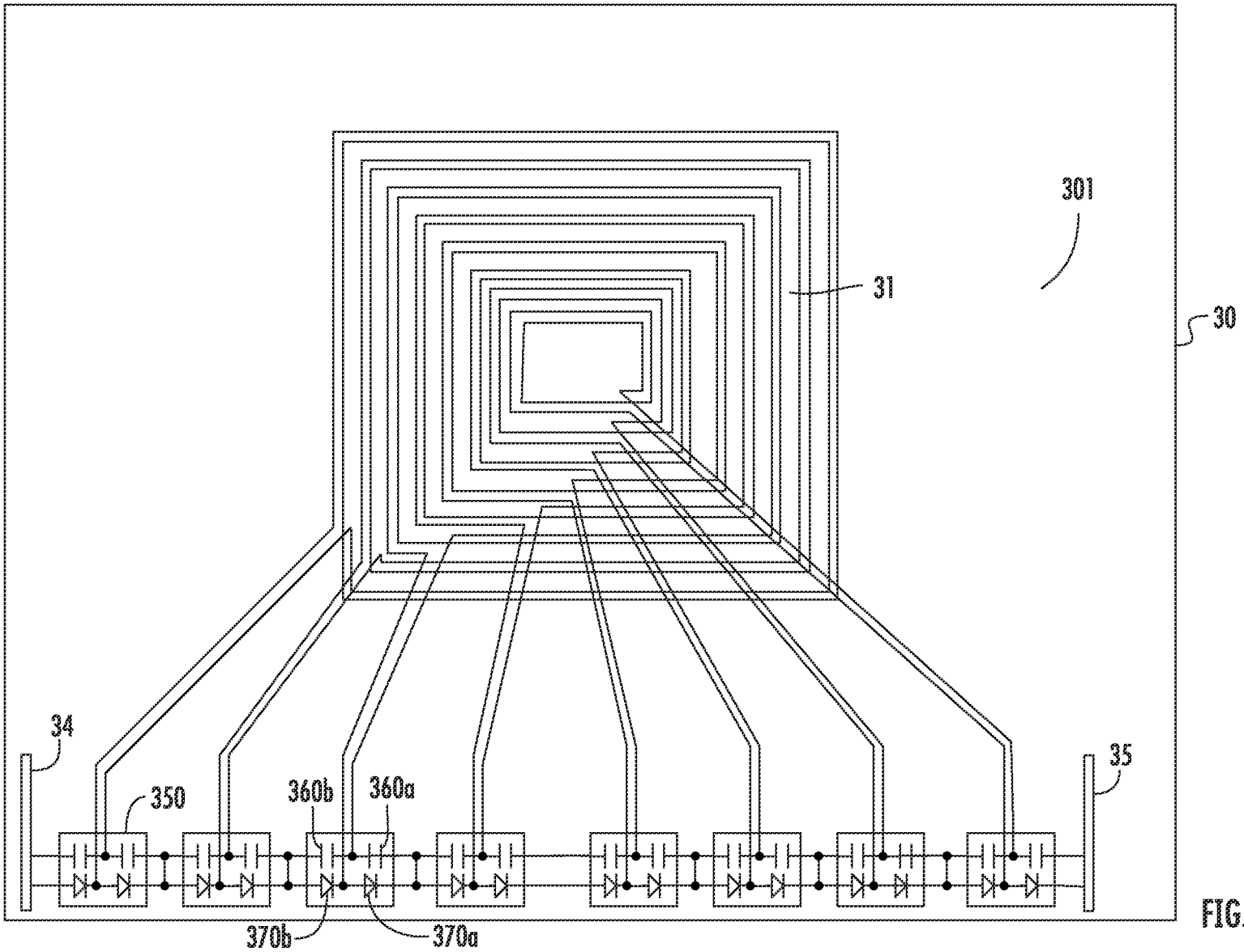
FIG. 3 shows a layout of a voltage doubler disposed on each of the printed circuit boards in the high voltage power supply of FIG. 1 according to another embodiment.

FIG. 3 shows a second embodiment of the high voltage doubler circuit 301 that may be disposed on each printed circuit board 30. In this embodiment, there is a plurality of secondary windings 31. Each secondary winding 31 is in communication with an associated low voltage doubler circuit 350. Each low voltage doubler circuit 350 comprises two capacitors 360*a*, 360*b* arranged in series, and two diodes 370*a*, 370*b* arranged in series. The first end of the secondary winding 31 is in electrical contact with the trace that connects the two capacitors 360*a*, 360*b*. The second end of the secondary winding 31 is in electrical contact with the trace that connects the anode of diode 370*a* to the cathode of diode 370*b*. The positive end of capacitor 360*a* is electrically connected to the cathode of diode 370*a*. The negative end of capacitor 360*b* is electrically connected to the anode of diode 370*b*.

The low voltage doubler circuits 350 are connected in series to create the high voltage doubler circuit 301. In other words, the cathode of diode 370*a* in one low voltage doubler circuit 350 is in electrical contact with the anode of diode 370*b* in the adjacent low voltage doubler circuit 350. Each low voltage doubler circuit 350 is electrically connected in series to at least one other low voltage doubler circuit 350 to form the high voltage doubler circuit 301.

The input to the first low voltage doubler circuit 350 is in electrical contact with the lower voltage 34, while the output of the last low voltage doubler circuit 350 is in electrical contact with the higher voltage 35.

Regardless of which voltage doubler circuit is employed, the higher voltage 35 of one printed circuit board 30 is electrically connected to the lower voltage 34 of the adjacent printed circuit board in the stack. In some embodiments, the voltage generated by the voltage doubler circuit on each printed circuit board is the same.

Thus, the output of the voltage doubler circuit of each PCB is in series with the voltage doubler circuit of the adjacent PCB, so as to cascade the voltage doubler circuits. For example, if ten PCBs are stacked together, where the voltage doubler circuit on each PCB generates 12.5 kV, the output voltage may be 125 kV. Of course, a different number of PCBs may be used and the voltage generated by each voltage doubler circuit may be different than the example provided above. The PCB that generates the output voltage may be referred to as the last printed circuit board. This last printed circuit board is the last PCB in the series. The first printed circuit board in the series may be referred to as the first printed circuit board. If the printed circuit boards are stacked vertically, as shown in FIG. 1, the first PCB may be the bottommost printed circuit board, while the last PCB may be the topmost printed circuit board. Of course, the stack may be inverted such that the last PCB is the bottommost printed circuit board.

While the above description refers to voltage doubler circuits, it is understood that these voltage multiplier circuits may not double the voltage. For example, a voltage tripler circuit, a voltage quadrupler circuit or a rectifier circuit may be used.

Referring again to FIG. 1, surrounding the stacked printed circuit boards 30 is a plurality of grading rings 40. Grading rings 40 are used to reduce the corona effect emitted by the ICT high voltage DC power supply 1. The grading rings 40 also serve to create a more even electrical potential along the stacked printed circuit boards 30. The grading rings 40 are made of an electrically conductive material, such as a metal. The grading rings may be circular rings and have an inner diameter that is larger than the dimension of the printed circuit board 30.

The last grading ring of the plurality of grading rings 40 is in communication with the output voltage, which may be generated by the last printed circuit board. Thus, the voltage applied to the last grading ring is equal to the output voltage of the ICT high voltage DC power supply 1. The first grading ring may in communication with the first printed circuit board, which may be the bottommost printed circuit board, as described in more detail below. In certain embodiments, there is at least one grading ring disposed between the last grading ring and the first grading ring. In some embodiments, there are a plurality of grading rings disposed between the last grading ring and the first grading ring.

The number of grading rings 40 may be different than the number of printed circuit boards 30.

High voltage resistors 50 are used to electrically connect adjacent grading rings 40. For example, if there are six grading rings 40, there are five high voltage resistors 50, arranged in series, that are used to create the voltage divider on the grading rings 40. The resistance of each high voltage resistor 50 may be the same. These high voltage resistors 50 form the high voltage resistor string.

Figure 4:
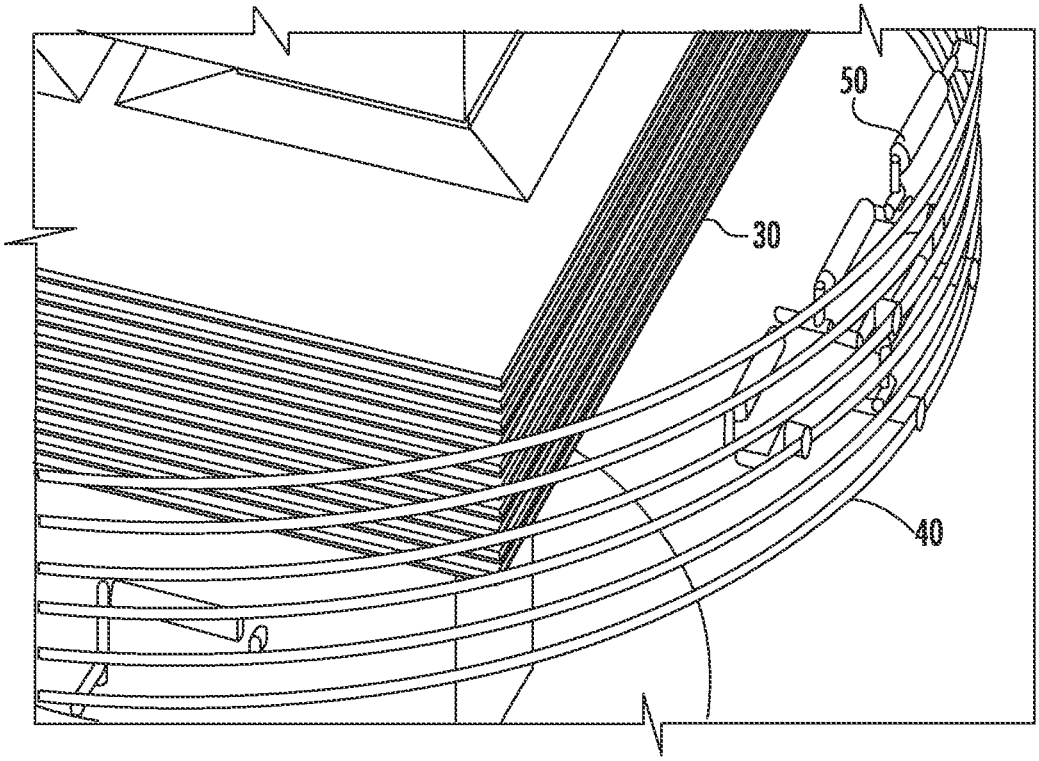
FIG. 4 shows a closer view of the resistor string used with the high voltage power supply of FIG. 1 according to one embodiment.

These high voltage resistors 50 may be attached directly to the grading rings 40, as best seen in FIG. 4. For example, the terminals of each high voltage resistor 50 may be clamped or otherwise affixed to two adjacent grading rings 40. The grading rings 40 and high voltage resistors 50 act as a shield capacitance to compensate for the stray capacitance. The high voltage resistors 50 are placed on the grading rings 40 such that the leakage from the stray capacitance is nearly or completely neutralized by the grading rings 40, making the voltage difference along the voltage divider nearly uniform.

Figure 5:
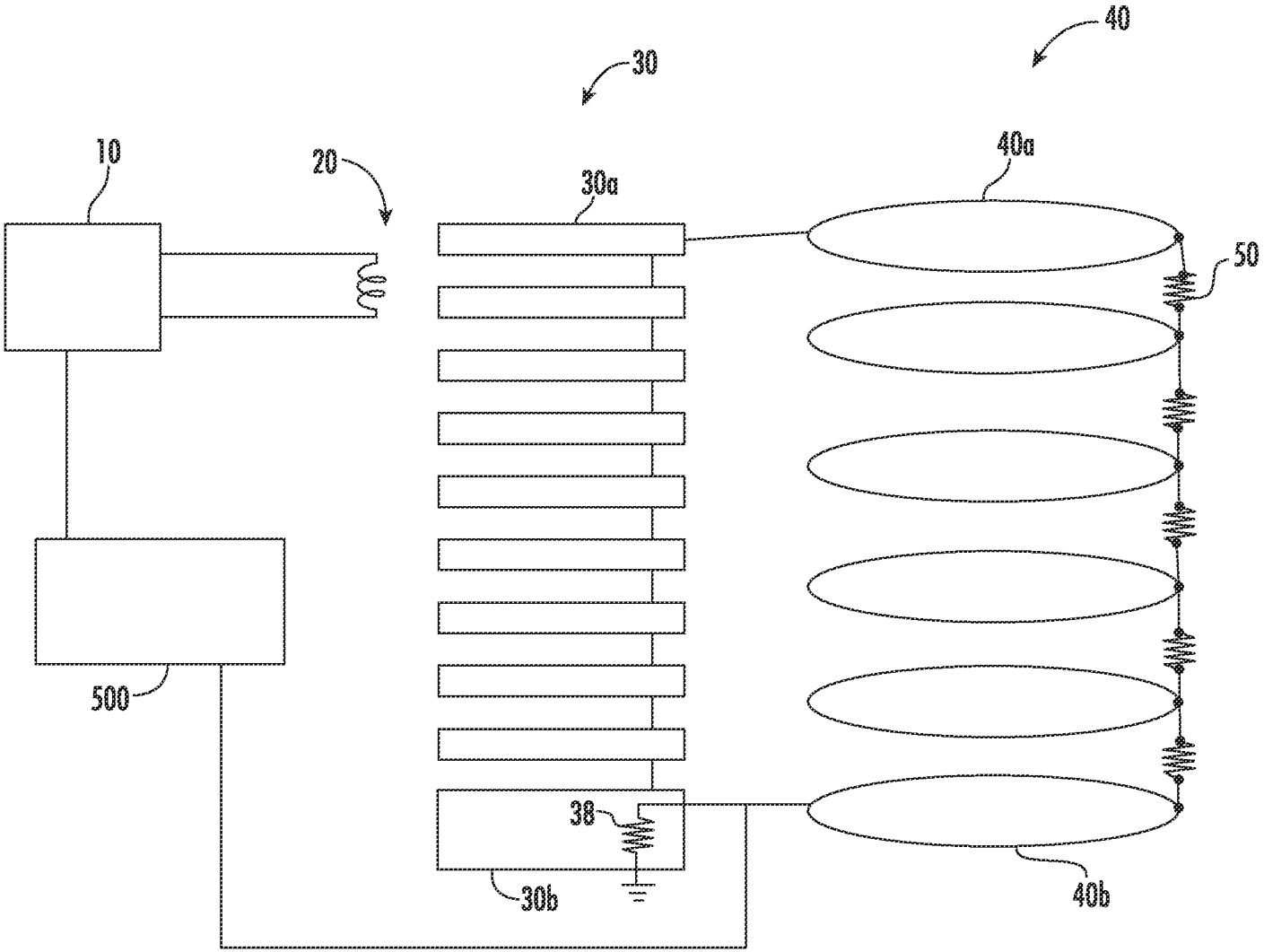
FIG. 5 shows the resistor divider disposed on the grading rings according to one embodiment.

FIG. 5 shows a block diagram showing ten stacked printed circuit boards 30 and six grading rings 40. The last grading ring 40*a* is in electrical communication with the output voltage, which is generated by the last printed circuit board 30*a*. High voltage resistors 50 are used to connect adjacent grading rings, such that there is a high voltage resistor between each pair of adjacent grading rings 40. The first grading ring 40*b* is in electrically communication with the first printed circuit board 30*b*. Note that none of the other grading rings 40 are in communication with the voltage produced by any of the other printed circuit boards. In certain embodiments, there is at least one printed circuit board disposed between the last printed circuit board 30*a* and the first printed circuit board 30*b*. In some embodiments, there are a plurality of printed circuit boards disposed between the last printed circuit board 30*a* and the first printed circuit board 30*b*.

The first grading ring 40*b* is electrically connected to a low voltage resistor 38 which may be disposed on the first printed circuit board 30*b*. For example, one terminal of the low voltage resistor on the first printed circuit board 30*b* may in communication with the first grading ring 40*b*, while the second terminal of the low voltage resistor may be in communication with ground. Alternatively, one terminal of the low voltage resistor 38 may be disposed on or near the first grading ring 40*b* while the second terminal of the low voltage resistor may be connected to ground. In these embodiments, the first grading ring 40*b* is not at ground, but at the voltage created by the voltage divider that includes the high voltage resistors 50 disposed on the grading rings 40 and the low voltage resistor 38 in communication with the first grading ring 40*b*. For example, if the high voltage resistors 50 disposed on the grading rings 40 are each 400 MΩ, and the low voltage resistor 38 is 160 kΩ, the voltage of the first grading ring 40*b* may be 10.000V.

In this embodiment, the voltage of the first grading ring 40*b* may be used as part of the feedback system 500 that controls the magnitude of the AC voltage power supply 10. The feedback system 500 may include a controller, such as a proportional controller, a proportional-derivation (PD) controller, a proportional-integral-derivative (PID) controller, or other type of controller. For example, if the voltage of the first grading ring 40*b* is less than the expected value, the feedback system 500 may increase the voltage output from the AC voltage power supply 10. Conversely, if the voltage of the first grading ring 40*b* is greater than the expected value, the feedback system 500 may decrease the voltage output from the AC voltage power supply 10.

Figure 6:
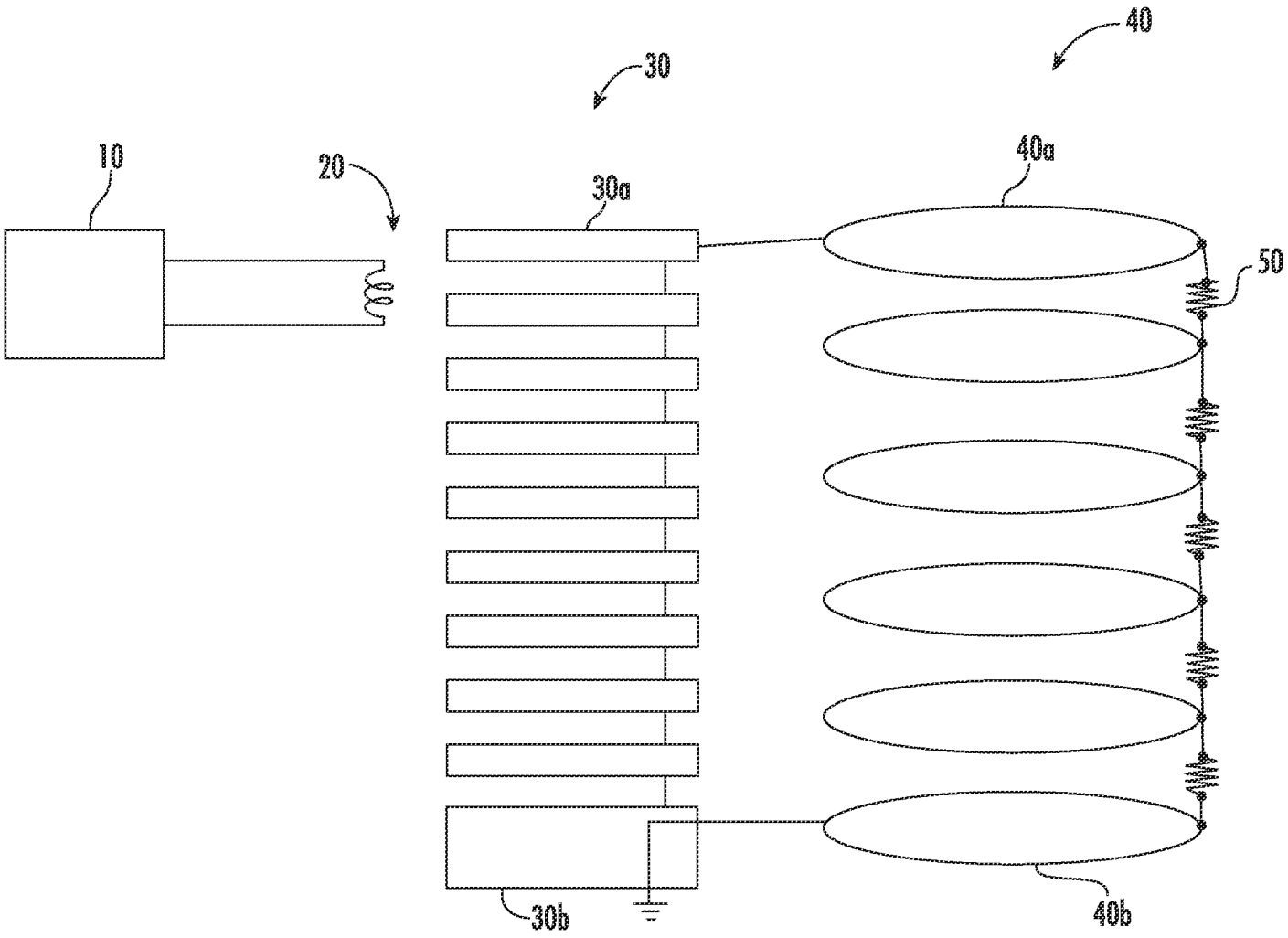
FIG. 6. shows the resistor divider disposed on the grading rings according to another embodiment.

According to another embodiment, shown in FIG. 6, the first grading ring 40*b* is electrically connected to ground. This may be via a connection to the first printed circuit board 30*b*. In this way, the voltage of each grading ring 40 is roughly equal to N*(output voltage)/M−1, where M is the number of grading rings 40 and N is the position of the grading ring in the series.

Specifically, the value of N for the first grading ring 40*b* is 0; and the value of N for the last grading ring 40*a* is M−1. Again, as described above, with respect to FIG. 4, only the last grading ring 40*a* is in communication with the output voltage of a printed circuit board 30. The remaining grading rings are only in communication with the adjacent grading rings, via high voltage resistors 50, except the first grading ring 40*b*, which is also in communication with ground.

As an example, if the output voltage is 125 kV and there are 6 grading rings, the voltage of the grading rings 40 may be 0, 25 kV, 50 kV, 75 kV, 100 kV and 125 kV, respectively. In this embodiment, the grading rings 40 do not provide feedback to the AC voltage power supply 10. Rather, in this embodiment, the high voltage resistors 50 serve to create a more uniform voltage gradient across the stacked printed circuit boards 30.

The system described herein has many advantages. Simulations were performed for a high voltage power supply having an output of 125 kV. Ten printed circuit boards, each comprising a voltage doubler circuit were employed. In one embodiment, grading rings 40 were not employed, and the high voltage resistors 50 described above were disposed on one or more of the printed circuit boards. There are five high voltage resistors 50, each having a resistance of 400 MΩ. Additionally, the low voltage resistor 38, having a resistance of 160 kΩ, was also disposed on one of the printed circuit boards. As described above, these six resistors form a voltage divider. Because of stray capacitance, the voltage across each high voltage resistor 50 in the high voltage resistor string is not uniform. Rather, because more current passes through the high voltage resistor 50 nearest the high voltage output, the voltage drop across this high voltage resistor 50 is the greatest. The voltage across each high voltage resistor 50 in the high voltage resistor string may decrease moving away from the high voltage output. For example, the simulated voltages at each resistor were as follows:

125.0 kV; 85.21 kV; 57.34 kV; 32.10 kV; 14.837 kV; and 9.394V.

Figure 7:
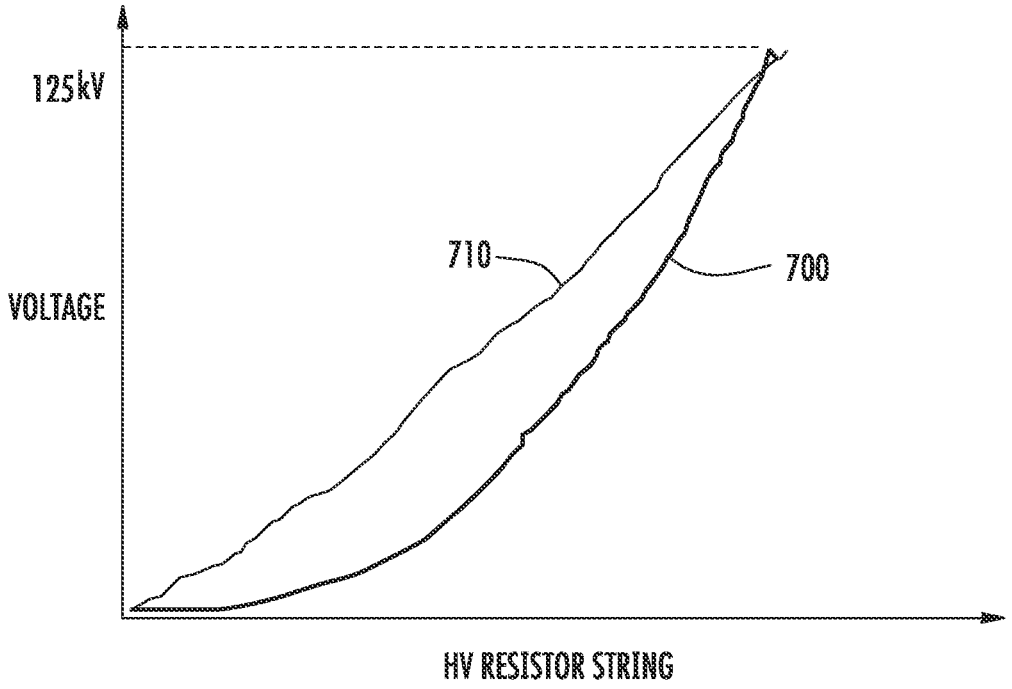
FIG. 7 shows the voltage distribution across the resistor divider in a high voltage power supply as compared to the prior art.

This voltages at each high voltage resistor are shown on line 700 of FIG. 7. This implies more voltage stress on the high voltage resistors near the high voltage output, which may lead to premature failure.

Further, using this embodiment, the voltage measured at the low voltage resistor 38 is less than the theoretical value. For example, if the output voltage is 125 kV, the voltage measured at the low voltage resistor 38 may theoretically be 10.000V. However, in this embodiment, the simulated voltage was only 9.4V, as noted above. This difference in voltage may affect the ability to accurately create the desired high voltage output.

However, when the grading rings 40 were introduced and the high voltage resistors 50 were disposed on the grading rings 40, as described in FIG. 5, the voltage uniformity is greatly improved. For example, the simulated voltages across the voltage divider may be:

125.0 kV; 98.960 kV; 75.340 kV; 48.66 kV; 24.34 kV; and 9.876V.

The voltage across the high voltage resistors 50 is shown in line 710 of FIG. 7. Specifically, rather than an error of 0.6V, the measurement error when the grading rings 40 are used is less than 0.125V. This is a four times reduction in the measurement error. In other embodiments, the measurement error may be reduced by a factor of at least 3.

Additionally, the voltage across each of the high voltage resistors 50 is now much more uniform and the voltage at the low voltage resistor 38 is much closer to the theoretical value. Thus, component reliability may be improved and the control of the high voltage output maybe more precise. This is due to the effect of the shielding capacitance created by the grading rings 40.

Furthermore, the placement of the high voltage resistors 50 between adjacent grading rings 40 also creates a more uniform potential gradient along the grading rings. For example, in certain embodiments, the voltage of each voltage doubler circuit may differ depending on design, load or other parameters. By using only the high voltage output and connecting the grading rings using a plurality of high voltage resistors, a more uniform voltage gradient may be created on the grading rings 40 than would otherwise be possible.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A high voltage DC power supply for generating a DC voltage, comprising:

a primary winding;

a plurality of stacked printed circuit boards, including a first printed circuit board and a last printed circuit board, each printed circuit board comprising:

a secondary winding, having a first end and a second end; and a voltage multiplier circuit, in communication with the secondary winding and having a high voltage output and a lower voltage; wherein the high voltage output of a first printed circuit board is in communication with the lower voltage of an adjacent second printed circuit board and the high voltage output of the last printed circuit board comprises the DC voltage; and a plurality of grading rings surrounding the plurality of stacked printed circuit boards, wherein a last of the plurality of grading rings is in communication with the DC voltage; and high voltage resistors disposed between adjacent grading rings to form a voltage divider, wherein a first of the plurality of grading rings is connected to one terminal of a low voltage resistor and a second terminal of the low voltage resistor is connected to ground, wherein a voltage across the low voltage resistor is indicative of the DC voltage.

2. The high voltage DC power supply of claim 1, comprising at least one additional printed circuit board disposed between the first printed circuit board and the last printed circuit board.

3. The high voltage DC power supply of claim 1, comprising at least one additional grading ring disposed between the first of the plurality of grading rings and the last of the plurality of grading rings.

4. The high voltage DC power supply of claim 1, wherein a voltage generated by each voltage multiplier circuit is the same.

5. The high voltage DC power supply of claim 1, further comprising an AC power supply in communication with the primary winding, and a feedback system in communication with the AC power supply.

6. The high voltage DC power supply of claim 5, wherein the voltage across the low voltage resistor is used by the feedback system to control an output of the AC power supply.

7. The high voltage DC power supply of claim 6, wherein a measurement error associated with the voltage across the low voltage resistor is reduced by a factor of at least 3, as compared to an embodiment wherein the plurality of grading rings are not employed.

8. The high voltage DC power supply of claim 1, wherein at least one of the plurality of stacked printed circuit boards comprises more than one voltage multiplier circuit.

9. The high voltage DC power supply of claim 1, wherein the voltage multiplier circuit comprises a voltage doubler circuit.

10. The high voltage DC power supply of claim 9, wherein the voltage doubler circuit comprises:

a capacitor string, comprising a plurality of capacitors arranged in series, wherein a negative end of a first capacitor in the capacitor string is at the lower voltage and a positive end of a last capacitor in the capacitor string is at the high voltage output; and a diode string, comprising a plurality of diode arranged in series, wherein an anode of a first diode in the diode string is connected to the lower voltage and a cathode of a last diode in the diode string is connected to the high voltage output; wherein the first end of the secondary winding is electrically connected to a midpoint of the capacitor string and the second end of the secondary winding is electrically connected to a midpoint of the diode string.

11. The high voltage DC power supply of claim 1, wherein each printed circuit board comprises at least one additional secondary winding, having a first end and a second end; and wherein the voltage multiplier circuit comprises:

a plurality of low voltage doubler circuits, arranged in series, to form the voltage multiplier circuit having the lower voltage at a first end and the high voltage output at a second end, wherein each low voltage doubler circuit comprises a positive end and a negative end and comprises a first capacitor and a second capacitor arranged in series and a first diode and a second diode arranged in series, wherein a positive end of the first capacitor is electrically connected to a cathode of the first diode and comprises the positive end of the low voltage doubler circuit, and a negative end of a second capacitor is electrically connected to an anode of the second diode and comprises the negative end of the low voltage doubler circuit, wherein a first end of a respective secondary winding is electrically connected to a trace connecting the first capacitor and the second capacitor, and the second end of the respective secondary winding is electrically connected to a trace connecting the first diode and the second diode.

12. A high voltage DC power supply for generating a DC voltage, comprising:

a primary winding;

a plurality of stacked printed circuit boards, including a first printed circuit board and a last printed circuit board, each printed circuit board comprising:

a secondary winding, having a first end and a second end; and a voltage multiplier circuit, in communication with the secondary winding and having a high voltage output and a lower voltage; wherein the high voltage output of a first printed circuit board is in communication with the lower voltage of an adjacent second printed circuit board and the high voltage output of the last printed circuit board comprises the DC voltage; and a plurality of grading rings surrounding the plurality of stacked printed circuit boards, wherein a last of the plurality of grading rings is in communication with the DC voltage; and high voltage resistors are disposed between adjacent grading rings to form a voltage divider, wherein a first of the plurality of grading rings is connected to ground.

13. The high voltage DC power supply of claim 12, comprising at least one additional printed circuit board disposed between the first printed circuit board and the last printed circuit board.

14. The high voltage DC power supply of claim 12, comprising at least one additional grading ring disposed between the first of the plurality of grading rings and the last of the plurality of grading rings.

15. The high voltage DC power supply of claim 12, wherein a voltage generated by each voltage multiplier circuit is the same.

16. The high voltage DC power supply of claim 12, wherein at least one of the plurality of stacked printed circuit boards comprises more than one voltage multiplier circuit.

17. The high voltage DC power supply of claim 12, wherein the voltage multiplier circuit comprises a voltage doubler circuit.

18. The high voltage DC power supply of claim 17, wherein the voltage doubler circuit comprises:

a capacitor string, comprising a plurality of capacitors arranged in series, wherein a negative end of a first capacitor in the capacitor string is at the lower voltage and a positive end of a last capacitor in the capacitor string is at the high voltage output; and a diode string, comprising a plurality of diode arranged in series, wherein an anode of a first diode in the diode string is connected to the lower voltage and a cathode of a last diode in the diode string is connected to the high voltage output; wherein the first end of the secondary winding is electrically connected to a midpoint of the capacitor string and the second end of the secondary winding is electrically connected to a midpoint of the diode string.

19. The high voltage DC power supply of claim 12, wherein each printed circuit board comprises at least one additional secondary winding, having a first end and a second end; and wherein the voltage multiplier circuit comprises:

a plurality of low voltage doubler circuits, arranged in series, to form the voltage multiplier circuit having the lower voltage at a first end and the high voltage output at a second end, wherein each low voltage doubler circuit comprises a positive end and a negative end and comprises a first capacitor and a second capacitor arranged in series and a first diode and a second diode arranged in series, wherein a positive end of the first capacitor is electrically connected to a cathode of the first diode and comprises the positive end of the low voltage doubler circuit, and a negative end of a second capacitor is electrically connected to an anode of the second diode and comprises the negative end of the low voltage doubler circuit, wherein a first end of a respective secondary winding is electrically connected to a trace connecting the first capacitor and the second capacitor, and the second end of the respective secondary winding is electrically connected to a trace connecting the first diode and the second diode.

* * * * *